US005590786A

United States Patent [19]

Jaycox

[11] Patent Number: 5,590,786

[45] Date of Patent: Jan. 7, 1997

[54] PACKAGE FOR LIQUID CONTAINERS

[76] Inventor: Donald L. Jaycox, 108 Zapata, Fenton, Mo. 63026

[21] Appl. No.: 533,733

[22] Filed: Sep. 26, 1995

[51] Int. Cl.[6] ..... B65D 81/02

[52] U.S. Cl. ..... 206/587; 206/521; 206/431; 206/590

[58] Field of Search ..... 206/521, 526, 206/591, 592–594, 587, 588, 589, 590, 431, 446

[56] References Cited

U.S. PATENT DOCUMENTS

| | | | |
|---|---|---|---|
| 3,458,035 | 7/1969 | Orthober | 206/431 |
| 3,527,405 | 9/1970 | Harding | 206/521 |
| 4,895,249 | 1/1990 | Davis et al. | 206/593 |
| 5,145,060 | 9/1992 | Maye | 206/446 |
| 5,197,606 | 3/1993 | Lancaster | 206/589 |
| 5,462,171 | 10/1995 | Moog et al. | 206/592 |

*Primary Examiner*—Paul T. Sewell
*Assistant Examiner*—Luan K. Bui
*Attorney, Agent, or Firm*—Armstrong, Teasdale, Schlafly & Davis

[57] ABSTRACT

A package for holding a plurality of F-style containers, each having a generally rectangular cross section and a spout and an inverted U-shaped strap handle projecting from the top. The package comprises a box having a top, a bottom, and a sidewall therebetween. There is a bottom liner inside the box, adjacent the bottom. The bottom liner has a plurality of generally rectangular cutouts for receiving and retaining the bottoms of F-style containers. There is also a top liner inside the box, adjacent the top. The top liner comprising spaced apart upper and lower walls, the lower wall adapted to engage the tops of the containers held inside the box and having openings therein for receiving the spouts and handles of the containers held inside the box. The openings allow the spouts and handles of the containers to project into the space between the walls, to protect the spouts and handles, and secure the tops of the containers against lateral movement.

11 Claims, 3 Drawing Sheets

PACKAGE FOR LIQUID CONTAINERS

BACKGROUND AND SUMMARY OF THE INVENTION

This invention relates to a package for holding fluid containers, and in particular to a package for holding fluid containers to protect the containers from damage during storage and shipment.

A variety of household and industrial fluids, such as paint thinner, are packaged in standard F-style containers. An F-style container has a generally rectangular prismatic shape with a spout and an inverted U-shaped strap handle projecting from the top. While these F-style containers are convenient for the end user to store and use the fluids contained in them, these containers are not sturdy enough, particularly with their projecting spout and handle, to be conveniently stored and shipped without further packaging.

There are a myriad of government regulations concerning the proper packing, storing, and shipping, of many of the types of chemicals that are put in F-style containers. These regulations impose rigorous drop and impact standards that must be met in order to prevent leakage of these chemicals. Present packages for shipping these chemicals are typically very complicated or expensive. Many of these packages rely upon absorbent packing or filling material to help prevent chemical leaks, virtually conceding that some leakage will occur. Moreover, if the chemical does contaminate the packing material, the contaminated packing material presents a disposal problem.

The present invention relates to a package for holding F-style containers and other similar types of containers, to protect the containers from damage during storage and shipment. The package of the present invention is of very simple and relatively inexpensive construction, with a minimum of parts, and does not rely on a packing or filling material to protect the containers. The package is sturdy and has been found to resist current impact and drop tests without leakage from the containers held inside the package.

Generally, the package of the present invention comprises a conventional box with a top, a bottom, and a sidewall therebetween. There is a bottom liner inside the box, adjacent the bottom. This bottom liner has a plurality of cutouts for receiving and retaining the bottoms of the containers. There is also a top liner inside the box, adjacent the top. This top liner comprises spaced apart upper and lower walls, the lower wall adapted to engage the tops of the containers held inside the package and having openings therein for receiving the spouts and handles of the containers held inside the package. These openings allow the spouts and handles of the containers to project into the space between the walls. There are preferably separate openings in the lower wall of the top liner for the spout and the handle of each container.

In the preferred embodiment, the bottom liner comprises an elongate blank, folded on itself to form an upper ply and a lower ply, and the cutouts are in the upper ply. Also in the preferred embodiment, the upper liner is formed from a single elongate blank. The upper liner preferably comprises a generally rectangular first panel, having at least one generally centrally located slot therein. First and second spacer webs extend from opposite sides of the first panel at first and second fold lines, respectively. Second and third panels extend from the first and second spacer webs, respectively, along third and fourth fold lines. The second and third panels extend toward each other, generally parallel to the first panel. Third and fourth spacer webs extend from the second and third panels toward the first panel along fifth and sixth fold lines, respectively. There are tabs on the third and fourth spacer webs, opposite the fifth and sixth fold lines, which fit into and engage the at least one slot in the first panel.

The bottoms of the containers fit into the cutouts in the bottom liner, and the top liner is placed over the containers with the lower wall in abutment with the tops of the containers, and the spouts and handles of the containers projecting though the lower wall, into the space between the upper and lower walls. In the preferred embodiment the upper liner is assembled over the containers as they sit in the bottom liner, so that the first panel of the top liner, forming the lower wall, can be fit over the tops of the containers, with the spouts and handles projecting through their respective openings. The second and third panels can then be folded over to form the upper wall of the liner and protect the spouts and handles.

Thus, the package of the present invention is of simple and inexpensive construction. It has a minimal number of parts, yet it securing holds and protects containers without the need for packing or filling material. The package protects the containers during impacts and drops, particularly the vulnerable spouts and handles. These and other features and advantages of the invention will be in part apparent, and in part pointed out hereinafter.

BRIEF DESCRIPTION OF THE DRAWINGS

Corresponding reference numerals indicate corresponding parts throughout the several views of the drawings.

DETAILED DESCRIPTION OF THE PREFERRED EMBODIMENT

Figure 1:
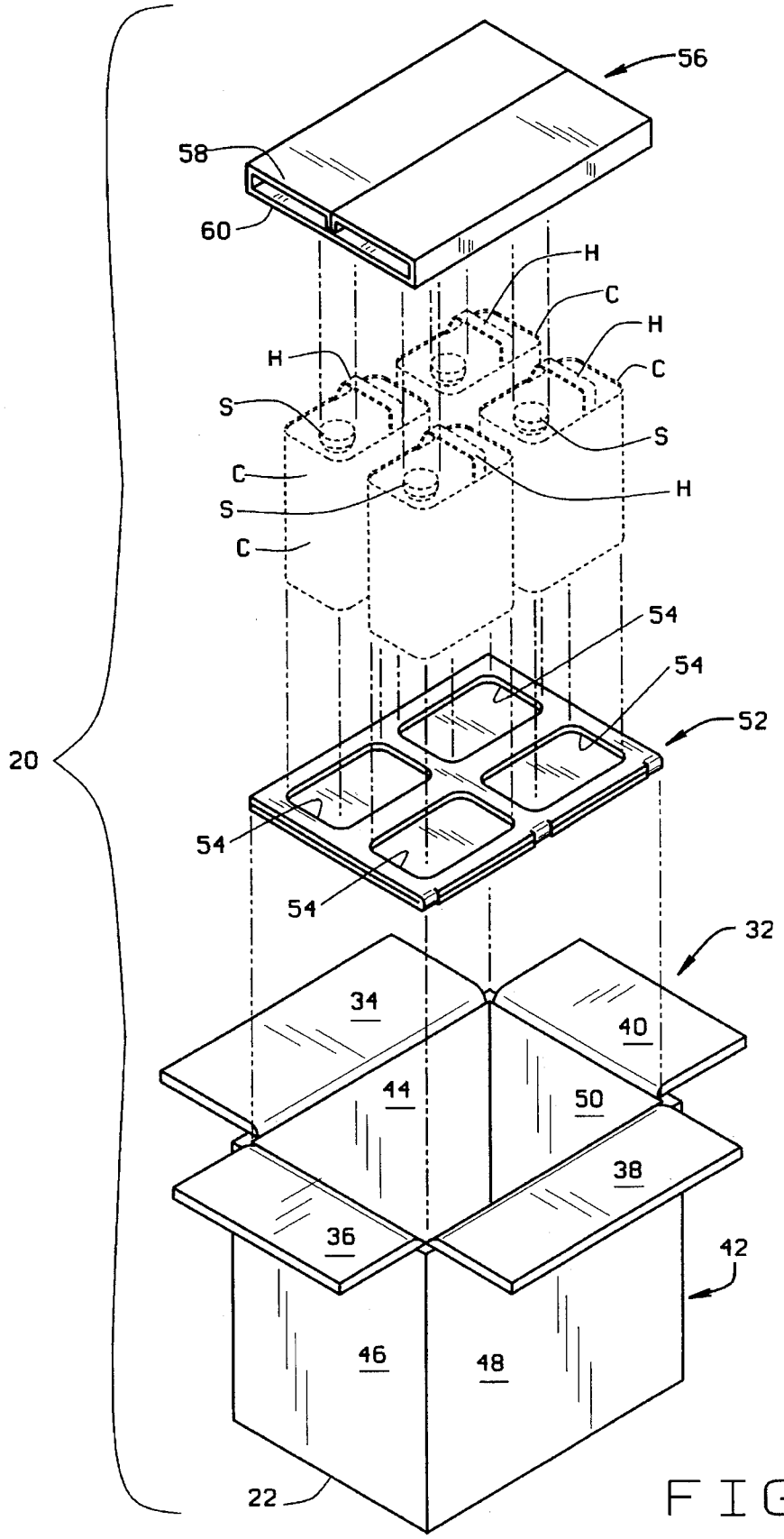
FIG. 1 is an exploded perspective view of a package constructed according to the principles of this invention.
Figure 2:
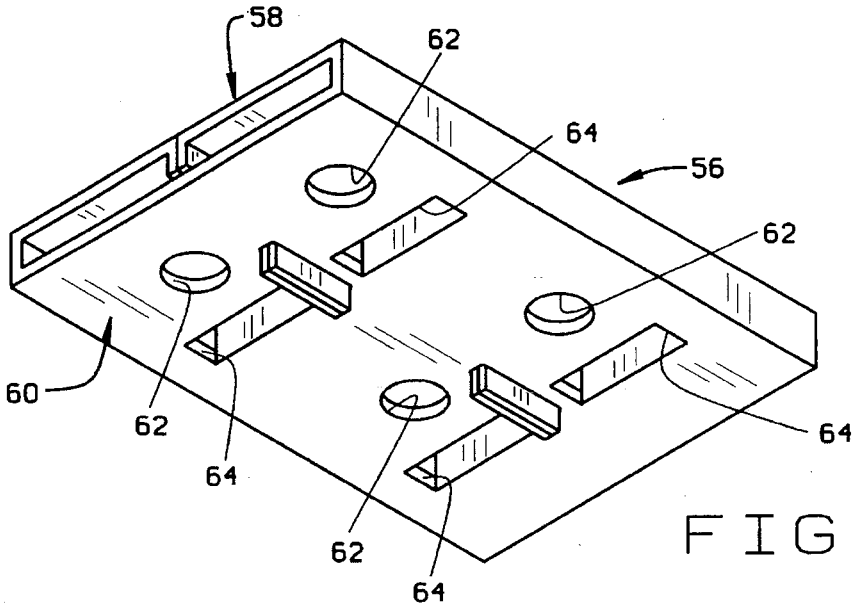
FIG. 2 is a perspective view from below of the top liner.

A package constructed according to the principles of this invention is indicated generally as 20 in FIG. 1. The package 20 is adapted to hold a plurality of containers C (shown in phantom) to protect the containers during storage and shipment. The invention is particularly adapted for use with standard F-style containers, of the type having a generally rectangular prismatic shape, having a rectangular cross-section with rounded corners. The containers C also include projecting spouts S, and inverted U-shaped strap handles H.

The container 20 comprises a box having bottom 22, formed by four overlapping flaps 24, 26, 28, and 30, a top 32, similarly formed by four overlapping flaps 34, 36, 38, and 40, and a sidewall 42, comprising four side panels 44, 46, 48, and 50.

The container 20 also comprises a bottom liner 52, adapted to fit inside the box, adjacent the bottom 22. The bottom liner 52 has a plurality of cutouts 54 adapted to receive and hold the bottoms of the containers C. The container 20 also comprises a top liner 56, adapted to fit inside the box adjacent the top 32. The top liner 56 comprises spaced apart upper and lower walls 58 and 60. The lower wall 60 is adapted to engage the tops of the containers C held inside the package, and has openings therein for receiving the spouts and handles of the containers held inside the package. There are preferably separate spout openings 62 and handle openings 64 for the spout S and handle H of each container. The openings 62 are preferably circular cut-outs. The openings 64 are preferably elongate slots formed by a wide u-shaped cut which forms a slot with a flap therein. The openings 62 and 64 allow the spouts and handles of the containers to project into the space between the walls. This helps protect the spouts and handles, and helps restrain the tops of the containers from lateral movement.

Figure 3:
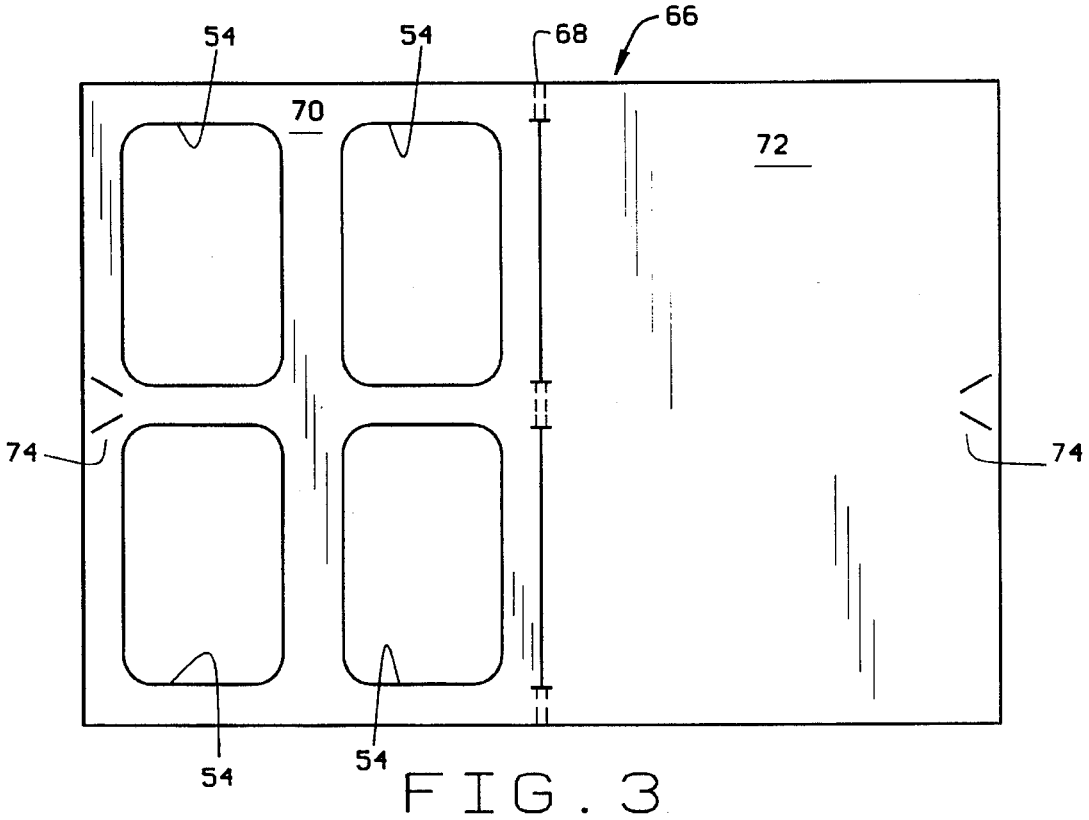
FIG. 3 is a top plan view of the blank from which the bottom liner is formed.
Figure 4:
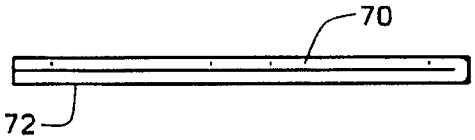
FIG. 4 is a side elevation view of the bottom liner.

As shown best in FIG. 3, the bottom liner 54 is preferably formed of a single elongate blank 66. The panel 66 is folded over itself along fold line 68, formed by cuts separated by uncut portions which act like hinges, to form two plies 70 and 72. The cutouts 54 are formed in the first ply 70, and hold the bottoms of the containers C against lateral movement. The second ply forms a cushion to protect the bottoms of the containers. There are preferably a plurality of dovetail cuts 74 which help to secure the plies together.

Figure 5:
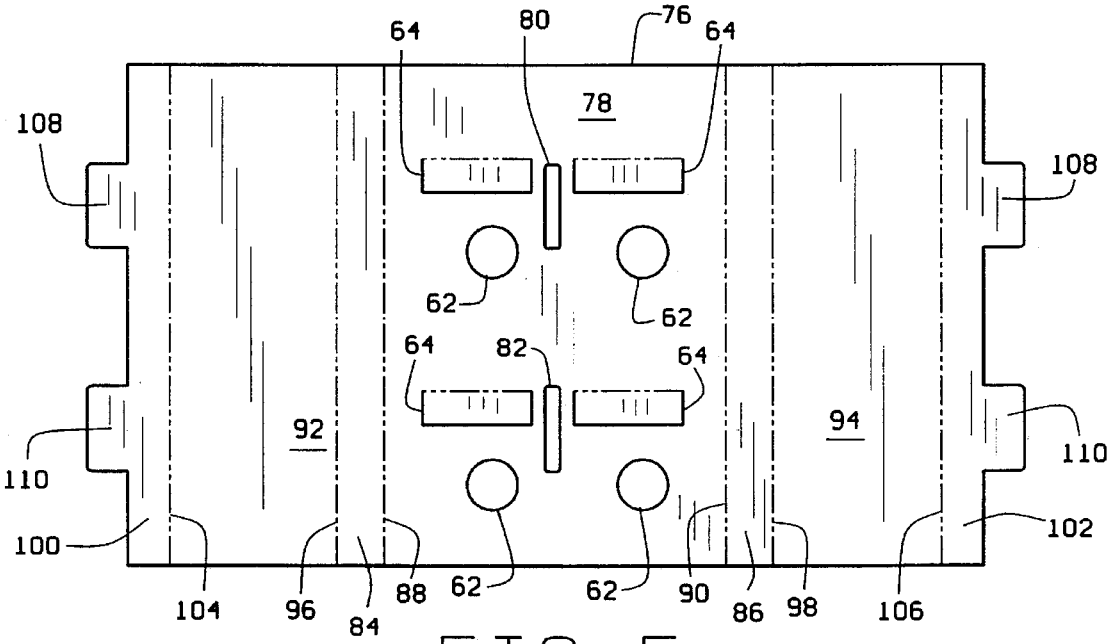
FIG. 5 is a top plan view of the blank from which the top liner is formed.
Figure 6:
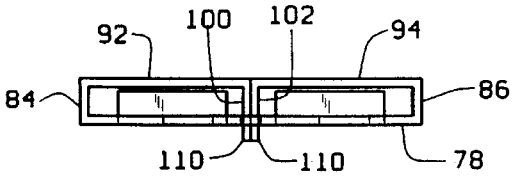
FIG. 6 is a side elevation view of the top liner.
Figure 7:
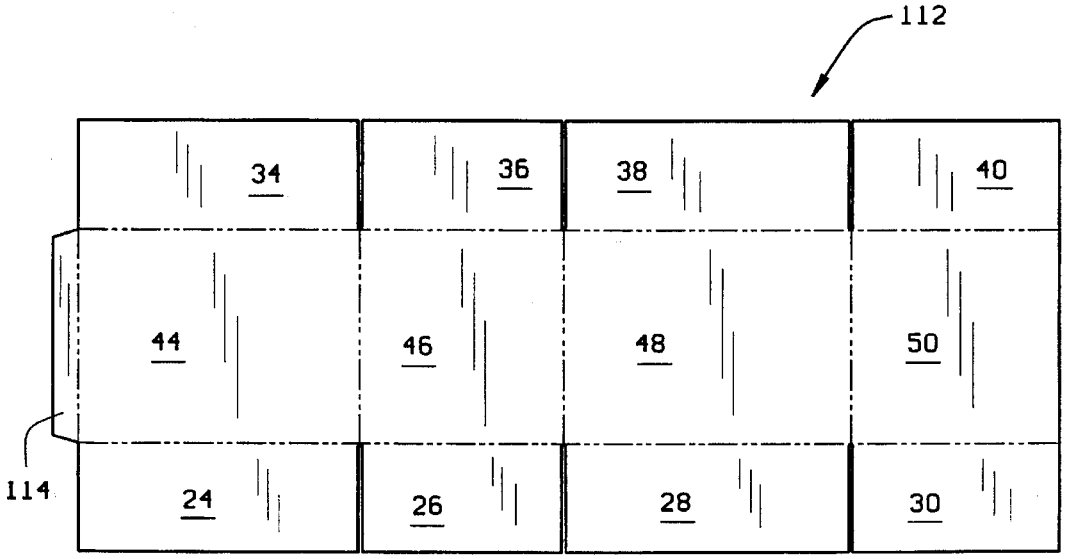
FIG. 7 is a top plan view of the blank from which the box is formed.

As best shown in FIG. 5, the top liner 56 is also preferably formed from a single elongate blank 76. As shown in FIG. 5 the top liner 56 preferably comprises a generally rectangular first panel 78, having at least one generally centrally located slot. In this preferred embodiment there are two slits 80 and 82. First and second spacer webs 84 and 86 extend from opposite sides of the first panel 78, at first and second fold lines 88 and 90. Second and third panels 92 and 94 extend from the first and second spacer webs 84 and 86, respectively, along third and fourth fold lines, 96 and 98. The second and third panels 92 and 94 extend generally toward each other, generally parallel to the first panel 78. Third and fourth spacer webs 100 and 102 extend from the second and third panels 92 and 94, respectively, toward the first panel 78, along fifth and sixth fold lines 104 and 106. There are tabs 108 and 110 tabs on each of the third and fourth spacer webs 100 and 102, opposite the fifth and sixth fold lines 104 and 106. These tabs 108 and 110 fit into the slots 80 and 82 in the first panel.

The first panel 78 forms the lower wall 60, which abuts the tops of the containers C, and has the openings 62 and 64, for accommodating the spouts S and handles H, respectively, of the containers.

The box is preferably formed from a single elongate blank 112. The blank 112 comprises the flaps 24, 26, 28, and 30, which form the bottom of the package, the flaps 34, 36, 38, and 40, which form the top 32 of the package, and the side panels 44, 46, 48, and 50, which for the sidewall 42 of the package. In addition, side panel 44 has a tab 114 which can be secured to side panel 50, for example with glue, to hold the box together.

OPERATION

In operation, the package is assembled. The blank 110 if folded to form a generally rectangular prismatic box, with a closed bottom 22, and a sidewall 42 and an open top. The bottom liner is then formed by folding the blank 66 upon itself. The liner is inserted into the box, with the cutouts 54 facing upwardly. A plurality of containers (in this preferred embodiment four arranged in two rows of two columns) are seated in the cutouts 54. The first panel 78 of the top liner, is then placed over the tops of the containers C, with the openings 62 and 64, receiving the spouts S and the handles H, respectively, of the containers, so that the first panel 78, which forms the lower wall 60 fits against the tops of the containers. When the first panel is properly seated, the second and third panels 92 and 94 can be folded over the first panel 78, the third and fourth spacer webs 100 and 102 are bend downwardly toward the first panel 78, and the tabs 108 and 110 on each spacer web are inserted into the slots 80 and 82 in the first panel. The package can then be sealed.

Once sealed, the cutouts 54 in the bottom liner 52 hold the bottoms of the containers C, and the openings 62 and 64 which receive the spouts and handles, hold the tops of the containers. The bottom ply 72 of the bottom liner 52, and the top wall 58 of the top liner 56 protect the bottoms and the tops of the containers. The spouts and the handles in particular are protected in the space formed between the upper and lower walls 58 and 60 of the top liner 56.

Thus the containers are held securely and protected from abuse during. The present package allows for the shipment of F-style and similar types of containers containing restricted substances, such as paint thinners and removers.

What is claimed:

1. A package for holding a plurality of F-style containers, each having a generally rectangular cross section and a spout and an inverted U-shaped strap handle projecting from the top, the package comprising:

a box having top, a bottom, and a sidewall therebetween;

a bottom liner inside the box, adjacent the bottom, the bottom liner having a plurality of generally rectangular cutouts for receiving and retaining the bottoms of F-style containers;

a top liner inside the box, adjacent the top, the top liner comprising spaced apart upper and lower walls, the lower wall adapted to engage the tops of the containers held inside the box and having openings therein for receiving the spouts and handles of the containers held inside the box, the openings allowing the spouts and handles of the containers to project into the space between the walls.

2. The package according to claim 1 wherein there are separate openings in the lower wall of the top liner for the spout and the handle of each container.

3. The package according to claim 1 wherein the bottom liner comprises an elongate, folded on itself to form an upper ply and a lower ply, and wherein the cutouts are in the upper ply.

4. The package according to claim 3 further comprising dovetail cuts in the each ply of the lower liner to hold the plies together.

5. The package according to claim 1 wherein the top liner comprises a generally rectangular first panel, having at least one generally centrally located slot therein; first and second spacer webs extending from opposite sides of the first panel at first and second fold lines, respectively; second and third panels extending from the first and second spacer webs, along third and fourth fold lines, toward each other, generally parallel to the first panel; third and fourth spacer webs extending from the second and third panels toward the first panel along fifth and sixth fold lines respectively; and tabs on the third and fourth spacer webs, opposite the fifth and sixth fold lines, which fit into and engage the at least one slot in the first panel.

6. The package according to claim 5 wherein the first panel forms the lower wall of the top liner.

7. The package according to claim 5 wherein the second and third panels form the lower wall of the top liner.

8. A package for holding a plurality of F-style containers, each having a generally rectangular cross section and a spout and an inverted U-shaped strap handle projecting from the top, the package comprising:

a box having a top, a bottom, and a sidewall therebetween;

a bottom liner inside the box, adjacent the bottom, the bottom liner having a plurality of generally rectangular cutouts for receiving and retaining the bottoms of F-style containers;

a top liner inside the box, adjacent the top, the top liner comprising a generally rectangular first panel, having at least one generally centrally located slot therein; first and second spacer webs extending from opposite sides of the first panel at first and second fold lines, respectively; second and third panels extending from the first and second spacer webs, along third and fourth fold lines, toward each other, generally parallel to the first panel; third and fourth spacer webs extending from the second and third panels toward the first panel along fifth and sixth fold lines respectively; and tabs on the third and fourth spacer webs opposite the fifth and sixth fold lines, which fit into and engage at least one slot in the first panel; the first panel forming a lower wall, and the second and third panels defining an upper wall spaced from the lower wall, the lower wall to engage the tops of containers held inside the box, and having openings therein for receiving the spouts and handles of the containers held inside the box, the openings allowing the spouts and handles of the containers to project into the space between the walls.

9. The package according to claim 8 wherein there are separate openings in the lower wall of the bottom liner for the spout and the handle of each container.

10. The package according to claim 8 wherein the bottom liner comprises an elongate, folded on itself to form an upper ply and a lower ply, and wherein the cutouts are in the upper ply.

11. The package according to claim 10 further comprising dovetail cut in the each ply of the bottom liner to hold the plies together.

* * * * *